US005675924A

United States Patent [19]

Predazzer

[11] Patent Number: 5,675,924

[45] Date of Patent: Oct. 14, 1997

[54] EJECTION DEVICE FOR FIREARM

[75] Inventor: René Predazzer, Flemalle, Belgium

[73] Assignee: FN Herstal S.A., Belgium

[21] Appl. No.: 687,430

[22] PCT Filed: Dec. 12, 1995

[86] PCT No.: PCT/BE95/00116

§ 371 Date: Aug. 9, 1996

§ 102(e) Date: Aug. 9, 1996

[87] PCT Pub. No.: WO96/18861

PCT Pub. Date: Jun. 20, 1996

[30] Foreign Application Priority Data

Dec. 12, 1994 [BE] Belgium ..... 09401123

[51] Int. Cl.[6] ..... F41A 15/16; F41A 9/41

[52] U.S. Cl. ..... 42/25; 89/33.03; 89/155; 89/47

[58] Field of Search ..... 42/25; 89/47, 33.03, 89/155, 156

[56] References Cited

U.S. PATENT DOCUMENTS

| | | | |
|---|---|---|---|
| 1,202,017 | 10/1916 | Barnes | 42/25 |
| 2,353,601 | 7/1944 | Tisdale, Sr. | 42/25 |
| 2,918,847 | 12/1959 | Barr | 42/25 |
| 3,584,532 | 6/1971 | Stonev et al. | 89/47 |
| 3,960,053 | 6/1976 | Couley | 89/149 |

FOREIGN PATENT DOCUMENTS

| | | | |
|---|---|---|---|
| 162176 | 8/1933 | Switzerland | 42/25 |

*Primary Examiner*—Stephen M. Johnson
*Attorney, Agent, or Firm*—Bacon & Thomas

[57] ABSTRACT

Ejection device for a firearm having an automatic or manual cycle, wherein the firearm includes a frame (1), a barrel (2) mounted on this frame (1) and which is equipped with a firing chamber (3) and movable elements (4) which can be moved backward in relation to the firearm (1) during recoil, and wherein the movable elements (4) include an extractor (9) for carrying along a casing (10) during recoil and an element (8) to close the chamber (3). The ejection device also contains an ejector (11) mounted in the closing element (8). The ejection device includes an ejection lever (16) mounted in a pivoting manner around a transverse axis (17) on the frame (1) at the back of the chamber (3), and including a guiding element (18) provided with a passage (19) for a casing (10). The ejection lever (16) tilts between a lower position whereat the entry of the its passage (19) is situated in the ejection trajectory of the case (10) as the movable elements (4) return forward and a higher position. A button (27) movable with a movable element is provided to eject the casing (10) through the passage (19) as the ejection lever (16) moves toward its higher position.

12 Claims, 5 Drawing Sheets

4
5
27
6
16
25
23
24
22
9
8
17
3
10
1
21
2

4
6
27
9
8
11
10
16
26
18
19
22
17
3
21
1
2

1
2
3
4
5
6
8
9
10
11
12
16
17
18
19
21
22
23
24
25
26
27
F10

1
2
3
4
5
6
8
9
10
11
12
13
16
17
18
19
21
22
23
24
25
26
27

EJECTION DEVICE FOR FIREARM

BACKGROUND OF THE INVENTION

1. Field of the Invention

The invention concerns an ejection device for a firearm having an automatic or manual cycle, the firearm including a frame, a barrel with a firing chamber mounted on the frame, and movable elements which can be moved backward in relation to the frame during the recoil, and wherein the movable elements include an extractor to carry along an ammunition cartridge or spent casing during the recoil and an element to close the chamber, with the ejection device including an ejector mounted in the closing element.

2. Discussion of Relate Art

Generally, in order to ensure the automatic or manual "extraction/ejection of the casing/feeding of the next ammunition" cycle of firearms and in particular of infantry arms, the above-mentioned movable elements such as the bolt, slide and breech bolt move, ensuring among others that the chamber of the firearm is closed.

During the recoil of the movable elements, a non-spent cartridge or spent casing is extracted from the chamber by means of the extractor which catches the casing by its neck.

After a sufficient course, a tilting torque of the casing is created by the ejector, which is fixed in the frame or mounted on a spring in the bolt which is generally positioned diametrically opposed to the extractor, which ensures an ejection trajectory of the casing situated approximately in a perpendicular plane to the axis of the firearm.

In order to avoid hurting a right-handed shooter, this trajectory, whose angle is determined by the relative positions of the ejector/extractor, is generally situated in a more or less perpendicular direction to the axis of the firearm and to the right of the firearm.

By means of special modifications, which are indispensable in so-called "bull pup" guns, the course of the movable elements of which is situated in the grip such that the trajectory would interfere with the head of the shooter, the ejection trajectory can be situated between the vertical line and the left so as to make the firearm more suitable for left-handed shooters.

This system is disadvantageous in that a far-reaching dismounting of the firearm is required, which is not very accessible to the user, so that the firearms are dedicated to left-handed and right-handed shooters, with the risk of harm in case of a mistake.

The invention aims to remedy this disadvantage and to provide an ejection trajectory which is suitable for both left-handed and right-handed shooters with one and the same firearm without any modifications being required, and thus aims to provide a truly ambidextrous firearm.

With this objection, the ejection device includes an ejection lever mounted in a pivoting manner around a transverse axis and a guiding element provided with a passage for a casing, whereby the ejection lever tilts between a lower position in which the entrance to this passage is situated along the trajectory of the casing as the movable elements return forward and a higher position above the lower position, and a button that ejects the casing out of the passage as the ejection lever moves towards its higher position.

Preferably, the button is made in one piece with one of the movable elements.

The ejection device may contain a spring pushing the ejection lever towards its lower position.

The tilting of the ejection lever towards its higher position is caused by the movable elements as they return forward, either with the help of the casing or by making direct contact.

BRIEF SUMMARY OF THE DRAWINGS

In order to better explain the characteristics of the invention, the following embodiment of the invention is given as an example only without being limitative in any way, with reference to the accompanying drawings, in which:

FIGS. 1 to 8 show a section of the part of the firearm represented in FIG. 1, but in different positions during the ejection of a cartridge;

DETAILED DESCRIPTION OF PREFERRED EMBODIMENT OF THE INVENTION

Figure 1:
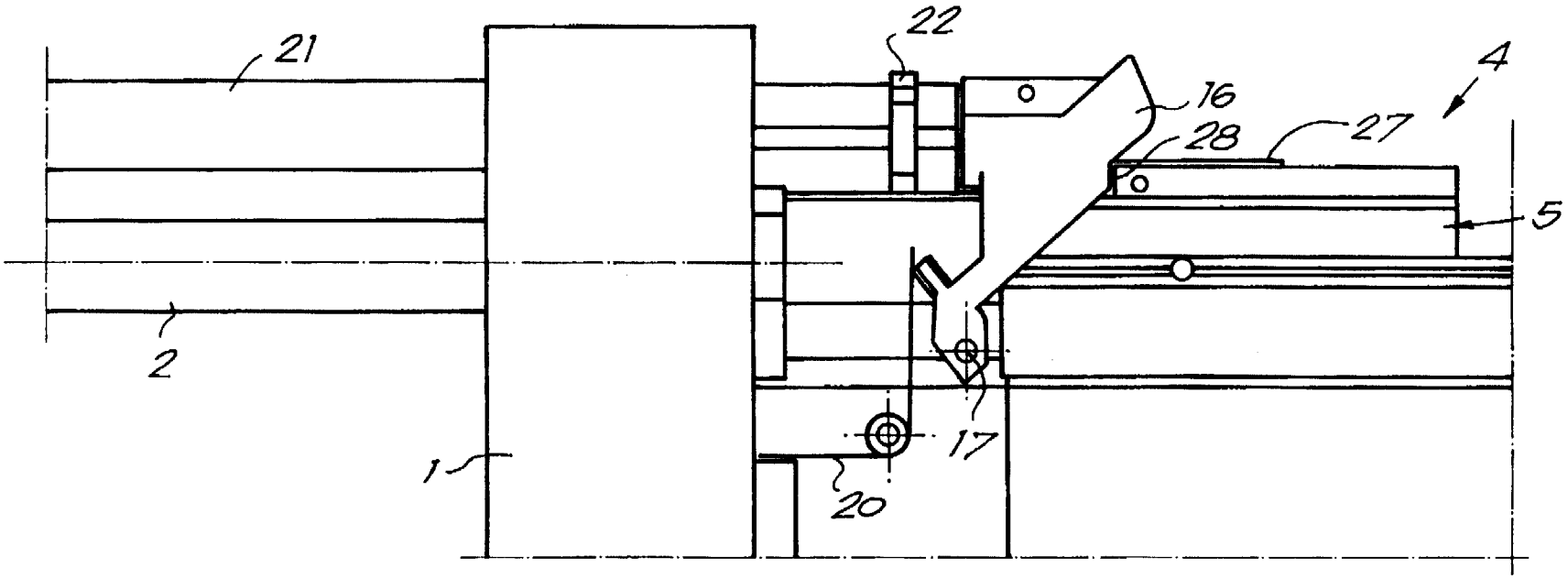
FIG. 1 shows a schematic side view of a part of a firearm equipped with an ejection device according to the invention.

FIGS. 1 to 8 show a part of a gas-operated firearm with a rotating bolt including a frame 1, a longitudinally extending barrel 2 mounted on this frame 1 and equipped at the back with a firing chamber 3 and a number of movable elements 4 which are moved backward during the recoil.

Said movable elements 4 include a slide 5 and a breech bolt 6 equipped at the front with a closing element 8 closing the chamber 3 during firing and an extractor 9.

During the recoil of the movable elements 4, the casing 10 is maintained in contact with the front side of the closing element 8 by means of an extractor 9 which has a conventional design.

However, the design of the ejection device differs from that of conventional devices.

First, the closing element 8 is not equipped with a conventional ejector, but with a front side 11 which is capable of relative movement, such that it does not provide for a sufficient tilting torque of the casing 10 during the recoil of the movable elements 4, but such that it exerts an axial force on the casing 10 ensuring retention of the casing 10.

The front side 11 of closing element 8 includes a distal end of an element 12 which can move in a cavity 13 in the closing element 8. A spring 14 (FIG. 10) is mounted between the element 12 and the bottom or proximal end of the cavity 13.

Figure 10:
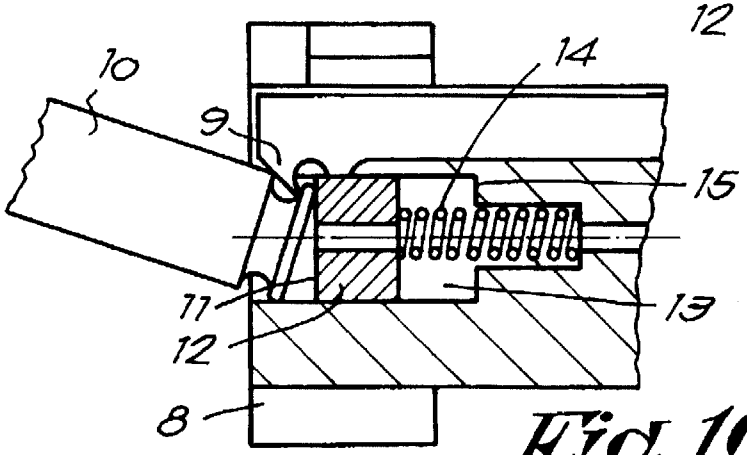
FIG. 10 shows a section to a larger scale of the part of the firearm indicated by F10 in FIG. 4.

If this front side 11 covers a major part of the rear surface of the casing 10, as is represented in FIG. 10, the closing element 8 contains a rear stop 15, formed by a part of the proximal end of the cavity 13, sufficient to support the back of the casing as the pressure rises in the chamber 3 (see FIG. 10).

The casing 10 is thus axially maintained during the complete recoil of the movable elements and their return forward.

Secondly, an ejection lever 16 is mounted at the back of the chamber 3 which pivots in relation to the frame 1 around a transverse axis 17.

The ejection lever 16 includes a guide element 18 through which extends a passage 19 for the casing 10.

Figure 2:
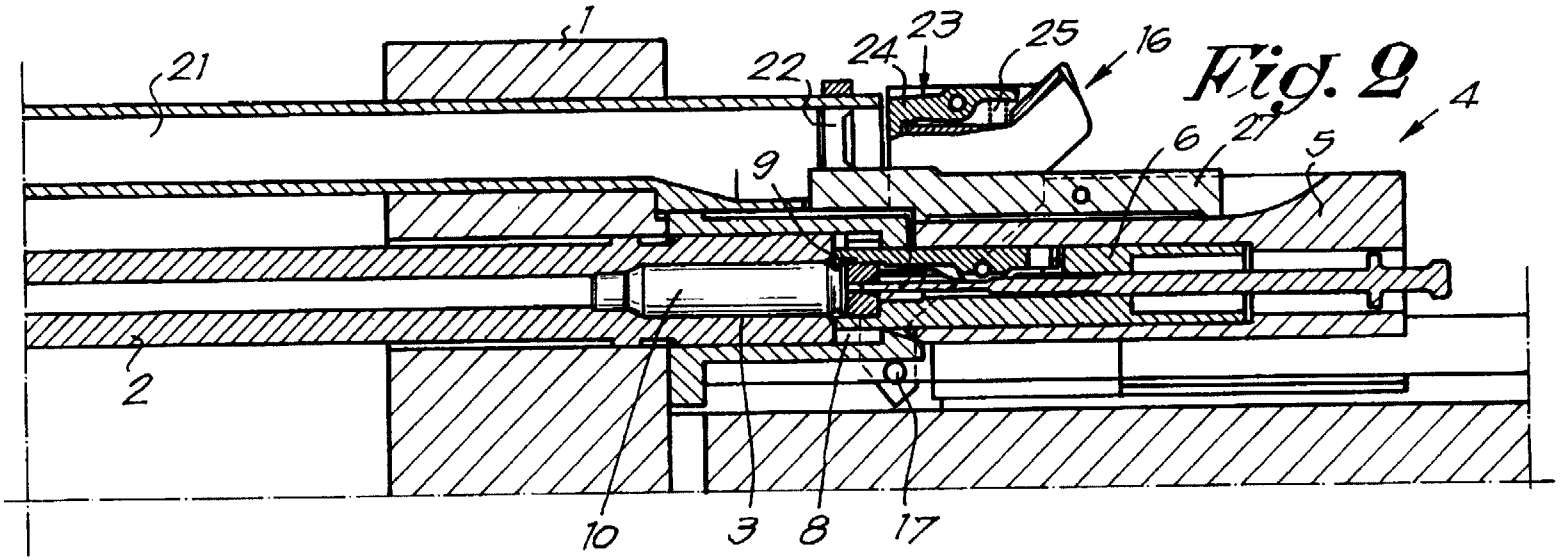
Figure 3:
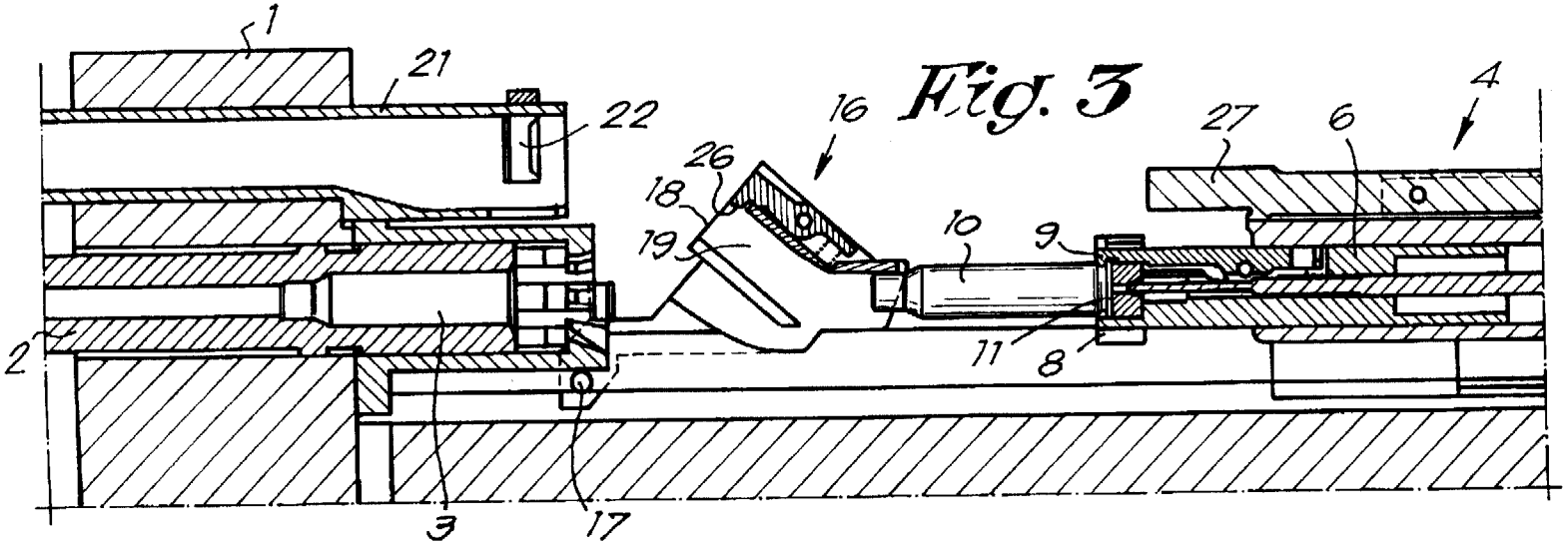
Figure 8:
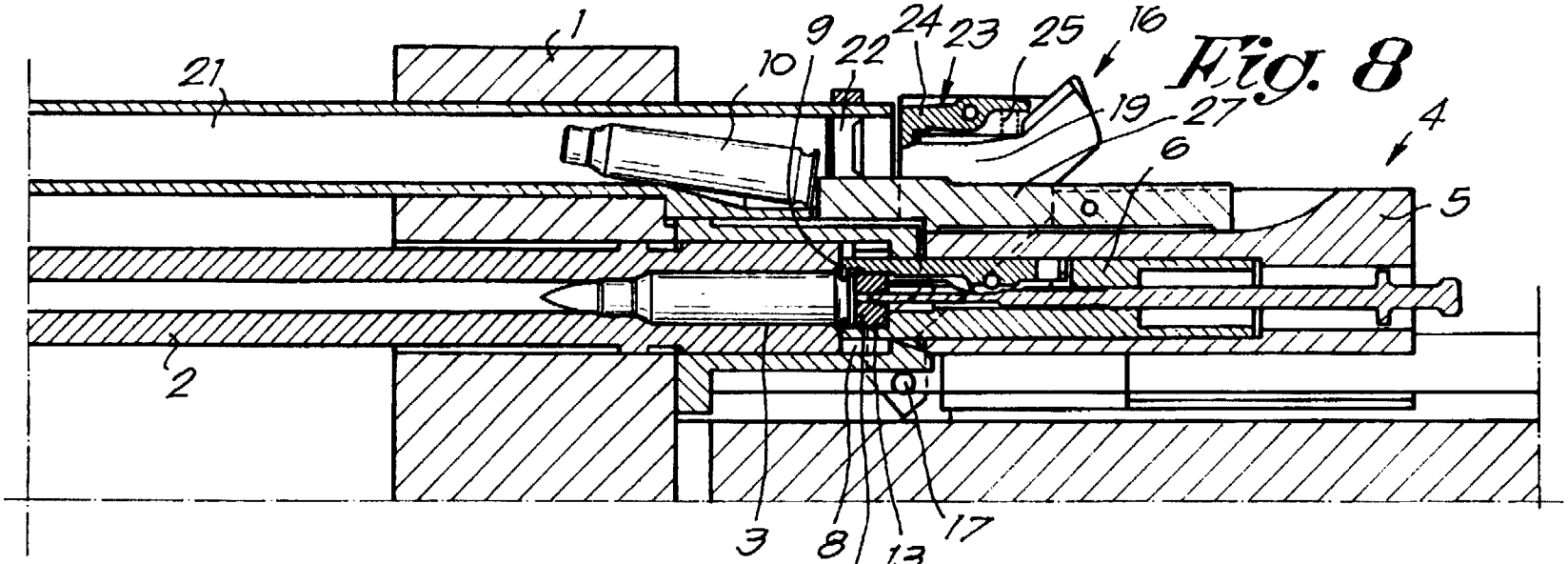

This ejection lever 16 can tilt between a lower position as represented in FIG. 3 and a higher position above the lower position as represented in FIGS. 1, 2 and 8.

In the lower position, the entrance to the passage 19 is situated in the trajectory of the casing 10 as the movable elements 4 and casing return forward.

In this position, the passage 19 is directed slantingly upward.

The ejection lever 16 is pushed towards it lower position by means of a spring 20 reacting against a part of the frame 1 that forms a stop.

In its higher position, the guiding element 18 is situated above the trajectory of the casing 10; this casing 10 can go under this guiding element 18 during the recoil and thus during the extraction of the casing 10.

In this higher position, the passage 19 opens above the barrel 2.

Moreover, an ejection tube 21 is mounted on the frame 1 above the barrel 2. In said higher position, the ejection lever 16 stops against the rear end of the ejection tube 21, so that when a casing is situated in the passage 19, it can be ejected through this ejection tube 21.

Figure 9:
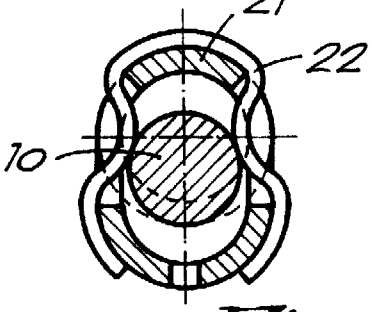
FIG. 9 represents a section according to line IX—IX of FIG. 7.

The rear end of the ejection tube 21 is provided with a non-return device 22, for example a restriction or openable closure, which prevents the casing 10 from returning to the ejection lever 16 and stopping its operation, as represented in detail in FIG. 9.

This non-return device 22 can be easily realized by means of a deformable element, a flat spring or fragmented membrane, etc.

This non-return device 22 can, apart from preventing the return, protect the inside mechanism of the firearm in relation to the outside environment and prevent dust, sand, etc. from penetrating.

On the guiding element 18 is mounted a brake 23 to decelerate the movement of the casing 10. This brake is composed of a lever 24 mounted in a pivoting manner on the guiding element 19 and it is pushed by a spring 25 in a position at which a block 26 mounted on a far end of the lever 24 extends inside the passage 19.

In order to be able to eject a casing out of the passage 19, a push rod or button 27 is mounted on the slide 5. The front end of this button protrudes forwardly relative to the slide 5 and extends into the passage 19 when the movable elements 4 return forward.

Moreover, a split can be made in the guiding element 18 so as to allow for the passage of a part of the front end of the button 27.

When shooting, the movable elements 4 are situated in their foremost position and the ejection lever 16 is maintained in its higher position against the ejection tube 21, in opposition to the spring 20, by a stop 28 situated on one of the movable elements 4 (see FIGS. 1 and 2).

During the recoil movement of the movable elements 4, the ejection lever 16 pivots around the transverse axis 17 as a result of the operation of the spring 20 to its lower position at which it presents the entrance of the passage 19 in the return trajectory of the casing 10 which is drawn in its rear position by the extractor 9, as represented in FIG. 3.

The casing 10 then comes forward, still being carried by movable elements 4.

Figure 4:
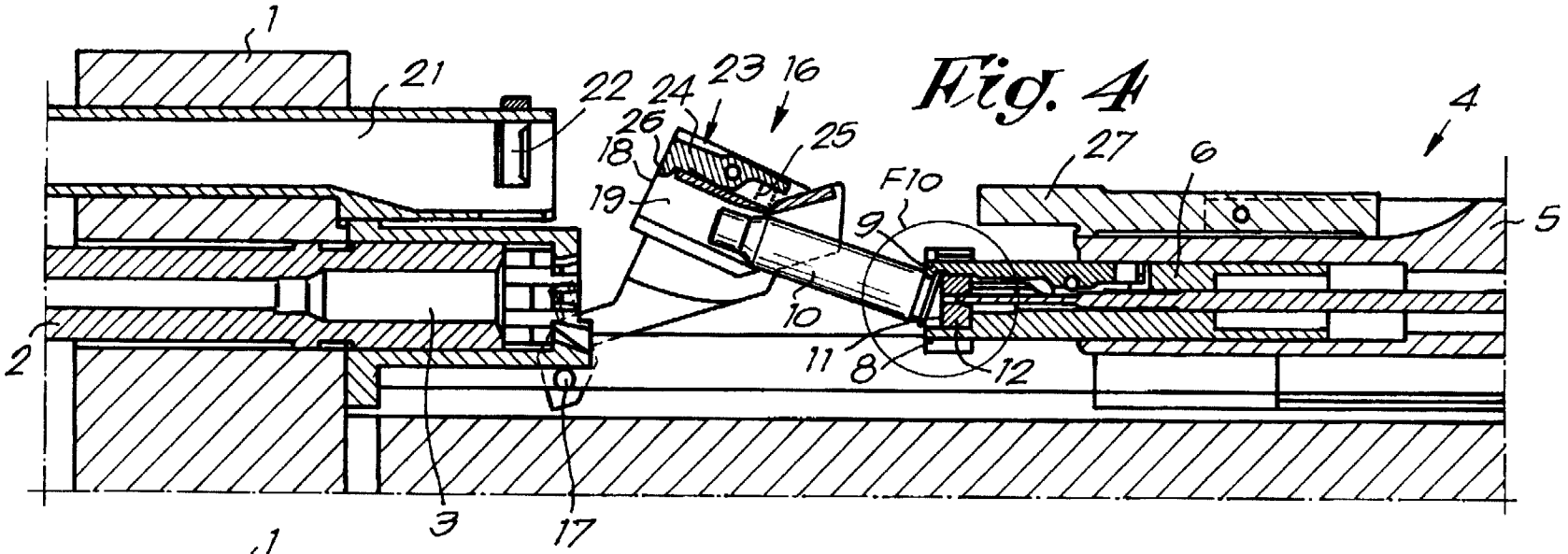

The ejection lever 16, provided its rotation axis 17 and the walls of the guiding element 18 forming the contact ramps are in the right position, is pushed upward again as a result of the forward movement of the casing 10, as represented in FIG. 4.

Figure 5:
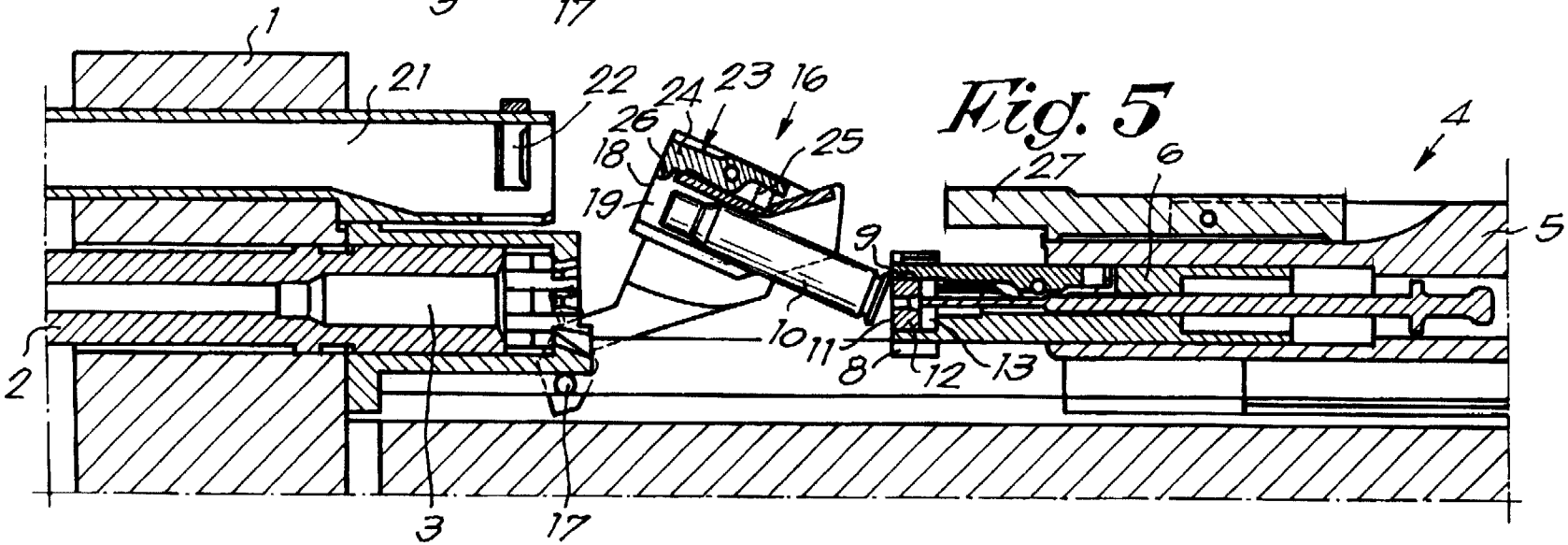

During its pivoting movement, the ejection lever 16 forces the casing 10 to pivot upward until the combined action resulting from the geometries of the front of the extractor 9 and of the front side 11 forming the ejector, ensures that the casing 10 is released from the extractor 9, as represented in FIG. 5.

Figure 6:
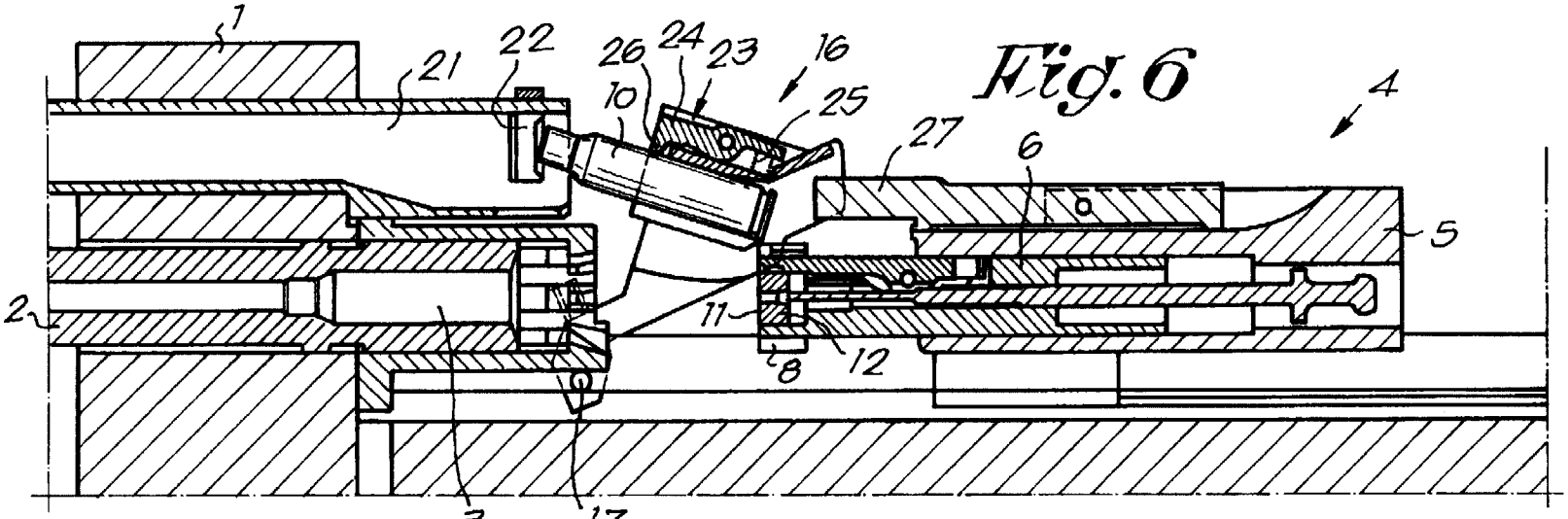

From that moment on, the casing 10 is guided by the ejection lever 16 which the movable elements 4 continue to push back, as represented in FIG. 6.

The casing 10 is decelerated in the passage 19 of the ejection lever 16 by the brake 23 exerting a lateral force on the casing 10.

Figure 7:
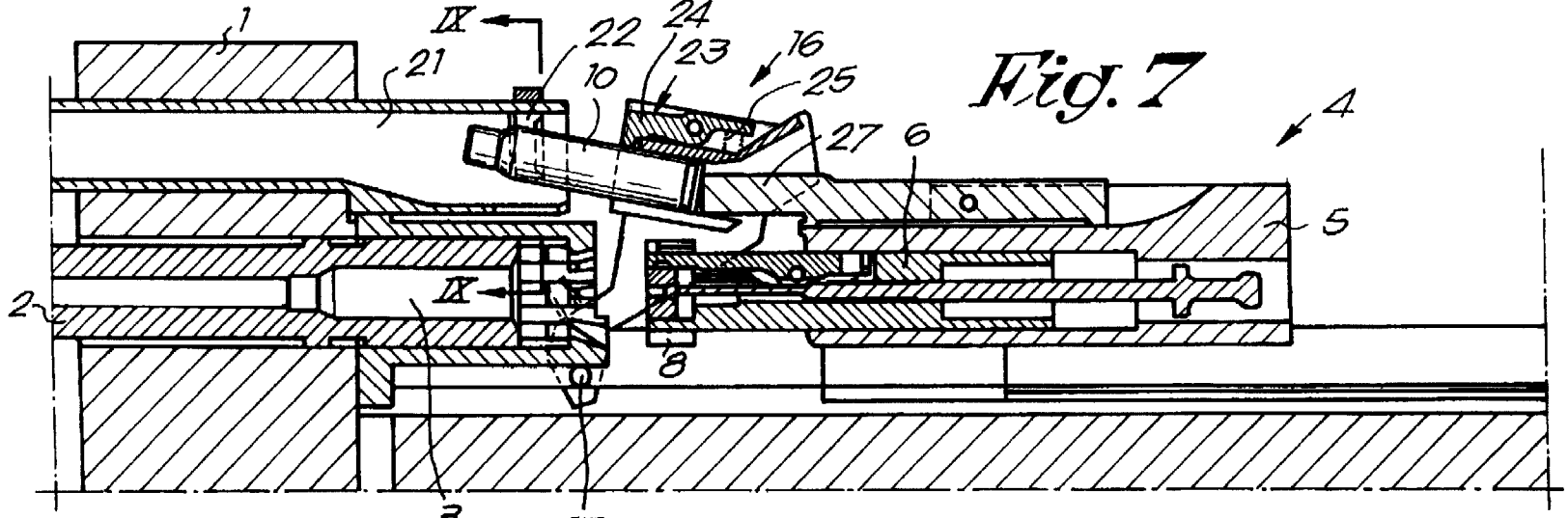

At the end of the motion of the ejection lever 16 at its higher position, the casing 10 is pushed forward again beyond the passage 19 by the button 27 which is carried along by the movable elements 4 and which forms a secondary ejector as represented in FIG. 7.

Once ejected out of the ejection lever 16, as represented in FIG. 8, the ejection cycle can be considered as finished, and the casing 10 is driven from the ejection lever 16 at a level of the firearm opening towards the exterior.

The ejection tube 21 makes it possible, for ergonomic reasons, to prolong the ejection, i.e., to bring the final ejection to the most appropriate place of the firearm.

The succession of the casings 10 pushing one after the other, ensures that the ejection tube 21 is emptied. The casing 10 remaining in the ejection tube 21 after firing has stopped can simply drop out of the tube as a result of the force of gravitation, e.g., by lowering the firearm.

During the return of the movable elements 4 towards the front and thus the upward motion and the ejection of the casing 10, the conventional feeding of the next cartridge is realized (pushing of the cartridge presented by the loader by means of the movable elements 4 and introduction into the chamber 3).

Thanks to the above-described ejection device, the casing 10 which has not been ejected yet and the ejection lever 16 ensure a guiding ceiling for the fed cartridge, such that the risk of a miscarried feeding is strongly reduced.

The ejection device does not only make it possible to eject empty casings, but also non-initialized or non-spent cartridges.

The pivoting to the higher position of the ejection lever 16 need not necessarily be caused by any of the above-mentioned movable elements 4. It can be caused, for example, by another movable element or by any other element whatsoever which makes a relative movement in relation to itself.

It is clear that numerous modifications can be made to the above-described example while still remaining within the scope of the invention.

In particular, the barrel need not necessarily be fixed in relation to the frame. The invention can be applied for example to a firearm of the type whose barrel is movable towards the front as is described in a patent application filed in Belgium in the name of the applicant.

I claim:

1. In an ejection device for a firm that includes a frame, a barrel mounted on the frame, a firing chamber associated with the barrel and movable elements which can be moved backward in relation to the frame during recoil, the movable elements including an extractor to carry along a cartridge casing during recoil, a closing element to dose the firing chamber, and an ejection device associated with the closing element, the improvement comprising:

said ejection device including an ejector lever pivotally mounted for rotation about a transverse axis, said ejection lever including a guiding element having a passage for a casing, said ejector lever pivotally movable between a lower position at which the entrance to said passage is situated along the trajectory of the casing as the movable elements return forward and a higher position; and a button for ejecting the casing through and out of the passage as the ejector lever pivots towards said higher position.

2. The improvement according to claim 1, wherein said button is integral with a part of the movable elements.

3. The improvement according to claim 1, further comprising a spring arranged to bias the ejector lever towards the said lower position.

4. The improvement according to claim 1, wherein at the lower position of the ejector lever, the passage is directed slantingly upwards towards the front of the firearm.

5. The improvement according to claim 1, including means for causing the ejector lever to tilt toward said higher position, said means comprising at least the forward motion of the movable elements.

6. The improvement according to claim 5, wherein the means for causing the ejector lever to tilt towards said higher position includes the forward motion of the casing.

7. The improvement according to claim 1, including a brake mounted on the ejector lever and arranged to decelerate the forward motion of the casing in said passage.

8. The improvement according to claim 7, wherein said brake includes a pivotally mounted lever including a block, said lever and block connected to the ejector lever, said brake arranged such that the block is extendable into the passage upon pivotal motion of the lever; and a spring biasing said lever in a direction to normally cause said block to extend into said passage.

9. The improvement according to claim 1, wherein the ejector device includes an ejector, wherein the ejector comprises a movable front end portion of said closing element.

10. The improvement according to claim 9, wherein said closing element includes a cavity at its front end and a spring; said front end portion being located and slidably movable in said cavity and biased by said spring in a forward direction.

11. The improvement according to claim 1, including an ejection tube mounted on the frame, said tube including a rearward facing end disposed opposite the said passage when the lever is located at said higher position.

12. The improvement according to claim 1, wherein the ejector lever is pivotally mounted on the frame.

* * * * *